US005389023A

United States Patent [19]

McIntyre

[11] Patent Number: 5,389,023

[45] Date of Patent: Feb. 14, 1995

[54] BODY SURFING BOARD

[76] Inventor: Jonothon M. W. McIntyre, 6733 Hinds Ave., North Hollywood, Calif. 91606

[21] Appl. No.: 212,363

[22] Filed: Mar. 14, 1994

Related U.S. Application Data

[63] Continuation-in-part of Ser. No. 36,112, Mar. 22, 1993, Pat. No. 5,318,467.

[51] Int. Cl.[6] ..... B63B 35/79

[52] U.S. Cl. ..... 441/65; 441/74; 441/79

[58] Field of Search ..... 441/65, 74, 79; 114/315; 472/129

[56] References Cited

U.S. PATENT DOCUMENTS

| | | | |
|---|---|---|---|
| D. 323,371 | 1/1992 | Ohtaka | D21/273 |
| 1,099,575 | 6/1914 | Skaszynski | 441/65 |
| 1,278,090 | 9/1918 | Barringer | 114/315 |
| 1,829,471 | 10/1931 | Brimhall | 441/65 |
| 1,843,617 | 2/1932 | Marshall | 441/65 X |
| 3,491,997 | 1/1970 | Winters | 441/65 |
| 4,302,860 | 12/1981 | Puch | 441/65 |
| 4,886,476 | 12/1989 | Brocone et al. | 441/65 |
| 5,007,871 | 4/1991 | Dyer | 441/65 |

FOREIGN PATENT DOCUMENTS 113128 2/1969 Denmark .

*Primary Examiner*—Sherman Basinger

*Attorney, Agent, or Firm*—Kelly, Bauersfeld & Lowry

[57] ABSTRACT

A body surfing board includes a flexible hull having a lower surface, an upper surface adapted to receive a swimmer, and a nose section defining a forward end of the hull. A tail section including a keel extends downwardly from the lower surface of the hull. A pair of fins extend downwardly from the hull along opposite lateral edges thereof. The fins are each pivotable along their respective attachment to the hull, inwardly and outwardly with respect to one another. A plurality of slits extend between the pair of fins for translating the force of a water wave into forward movement of the body surfing board. In one embodiment, a plurality of ribs fixed to the lower surface of the hull define the slits. In another embodiment, a plurality of ribs are positioned within the nose section of the hull to open and close the slits in response to movement of the fins. In still another embodiment, the slits are incorporated into a diaphragm member. A pair of pommels are fixed to the hull to support the backs of the swimmer's arms. The tail section may include a tail fin attached to the keel within one of a plurality of channels. The fins may include sleeves or external hand grips.

20 Claims, 5 Drawing Sheets

FIG. 4
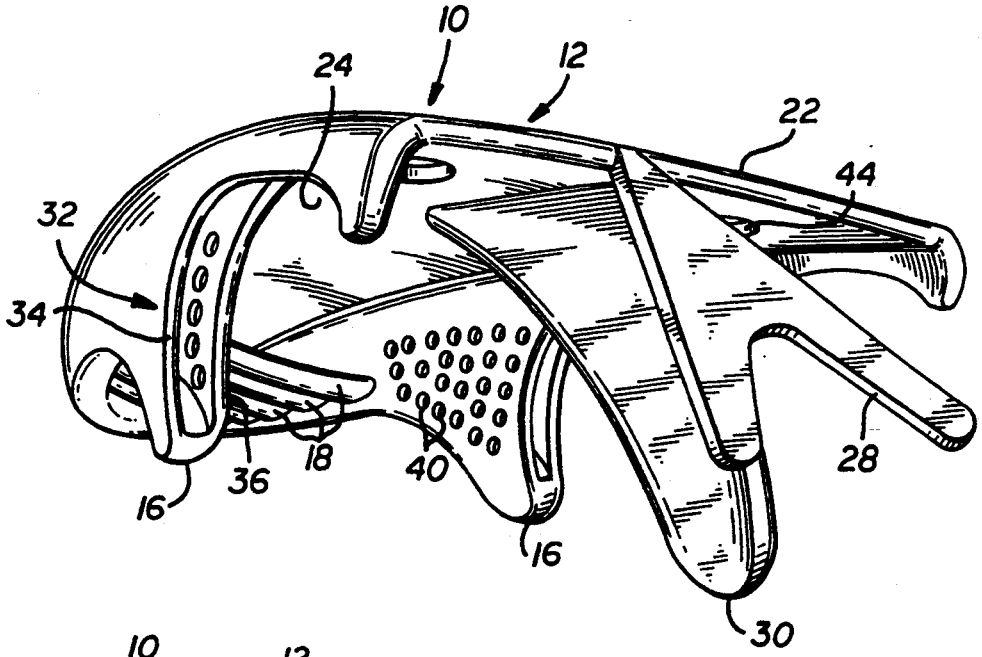
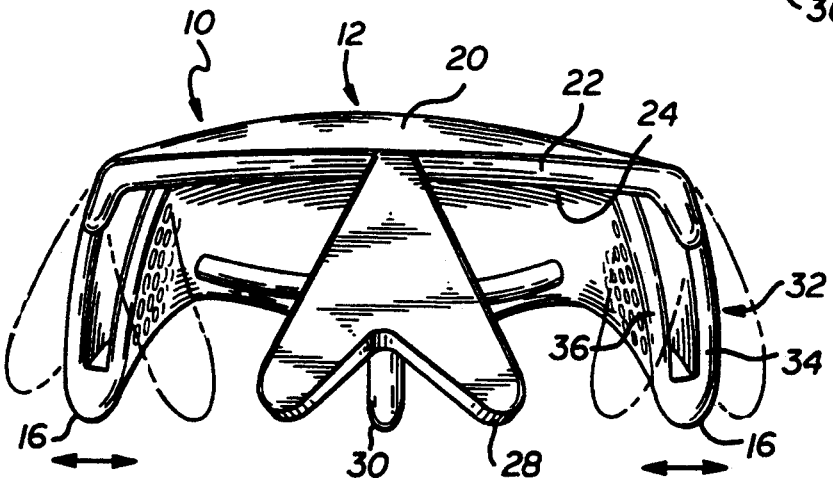
FIG. 5
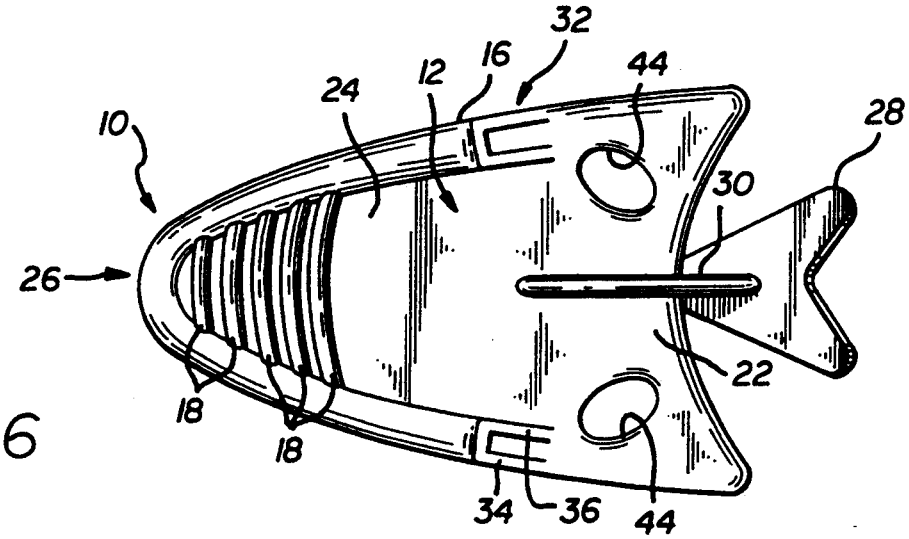
FIG. 6

BODY SURFING BOARD

This application is a continuation-in-part of application Ser. No. 08/036,112, filed Mar. 22, 1993, and entitled BODY BOARD which is now U.S. Pat. No. 5,318,467.

FIELD OF THE INVENTION

This invention relates generally to aquatic sporting goods. More specifically, this invention relates to a body board for prone surfing.

BACKGROUND OF THE INVENTION

The sport of riding a wave toward shore, i.e. surfing, has long been a popular pastime for some and a full-time obsession for others. Competitive surfing has grown into a large industry with its participants traveling the globe to take advantage of regional swell conditions. A surfing subculture has developed which has been featured in several movies and television series.

The surfing method of choice has varied depending on a swimmer's experience, swell conditions, budget, etc. Body surfing is favored by some, wherein the fully-extended body itself is propelled by the wave. Body surfing is relatively easy to learn and is most popular among those who don't want to invest the time required to learn other methods, or invest the money into surfing paraphernalia. It is especially popular among those who don't surf on a regular basis.

Boogie boarding has also become popular with the recreational or casual swimmer. Boogie boards are typically short rigid boards on which the swimmer lies prone and holds onto the board while riding the wave.

The most advanced form of surfing is stand-up surfing done on a long, narrow and somewhat rounded board known as a surfboard. It offers a challenge to the swimmer who must manipulate, maneuver, and stabilize the relatively large board while standing on it even in steep or tight turns with the wave crashing around the swimmer. While waiting for or moving to the wave, the swimmer sits or kneels on the surfboard while paddling, often resulting in a condition known as swimmer's knobs. Swimmer's knobs are tumorlike overgrowths of connective tissue just below the knees, on the tops of the feet, and often on the toes.

Body surfing, boogie boarding and traditional surfing all rely on the forces generated by a wave to propel a relatively flat, rigid object through the water. There is, therefore, a need for an improved body board which is constructed to efficiently utilize the forces generated by beach waves and provides the swimmer with greater control of his or her movement within the wave than that afforded by prior surfing techniques. Such an improved body board should be capable of riding smoothly, be comfortable to paddle and sit on, and appeal to the novice while still posing a challenge to the experienced swimmer. The present invention fulfills these needs and provides other related advantages.

SUMMARY OF THE INVENTION

The present invention resides in an improved body surfing board for riding a wave, which is easy to control and master, lightweight and buoyant, rides smoothly, and is comfortable to sit on. The body surfing board comprises, generally, a buoyant, resiliently flexible hull, a tail section including a keel extending downwardly and rearwardly from the hull, a pair of fins also extending downwardly from the hull along opposite lateral edges thereof, and propulsion means fixed to the lower surface of the hull, for translating the force of a water wave into forward movement of the body surfing board.

The hull includes a lower surface that rides on top of the water, an upper surface adapted to receive a swimmer in a chest down position with the feet of the swimmer projecting beyond a rear edge of the hull, and a nose section defining a forward end of the hull. The fins are each pivotable along their respective attachments to the hull, inwardly and outwardly with respect to one another.

In one preferred form of the invention, the propulsion means comprise a plurality of slits which are defined by a plurality of ribs provided within the nose section of the hull and which extend between the pair of fins. Means are provided for opening and closing the slits in response to inward and outward movement of the fins. In this regard, when the fins are flexed toward each other by the swimmer, the nose section slits open and the board moves forward. The nose section becomes more cone-shaped and water becomes displaced resulting in increased surfing speed. As the fins are extended laterally outwardly, the nose section slits close, minimizing the flow of displaced water and thus slowing down the body surfing board. The fins can be moved independently of one another to assist in controlling the direction of the board through the water.

Each fin includes an inner wall and an outer wall which define a sleeve therebetween. Apertures are provided through the inner sleeve, which are adapted to receiving the fingers of the swimmer.

In a second preferred form of the invention, the propulsion means includes a plurality of slits defined by a plurality of ribs fixed within the nose section of the hull and directly to the lower surface thereof. In this embodiment, each fin includes an outer surface having a plurality of hand grips for the swimmer, permitting the swimmer to control the inward and outward movement of the fins. Additionally, a pair of pommels are fixed to the hull which extend upwardly therefrom adjacent to the rear edge of the hull. The pommels provide means for supporting the back of the swimmer's arms.

In a third preferred form of the invention, the propulsion means includes a plurality of slits incorporated into a diaphragm member provided within the nose section. Means are also provided for opening and closing the slits in response to inward and outward movement of the fins.

Each fin includes an inner wall and an outer wall which define a sleeve therebetween. Apertures are provided through the inner sleeve which are adapted to receive the fingers of the swimmer. Again, a pair of pommels are fixed the hull which extend upwardly therefrom adjacent to the rear edge of the hull. The pommels provide means for supporting the back of the swimmer's arms.

The tail section includes a tail fin attached to the keel. The tail fin extends in a plane generally perpendicular to the plane of the keel. The keel includes a plurality of tail fin-receiving channels into any one of which the tail fin is placed for attaching the tail fin to the keel. The tail fin-receiving channels are angularly displaced, one from another.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 4 is another perspective view of the body surfing board shown in FIGS. 1–3, illustrating the concave underside of the board with a plurality of nose section ribs and a pair of fin sleeves;

FIG. 5 is a rear elevational view of the body surfing board, illustrating movement of the fins as shown by the arrows;

FIG. 6 is a bottom plan view of the body surfing board, illustrating the plurality of ribs in the underside of the nose section and a pair of openings in a hull of the board aft of the fins through which the swimmer's arms extend to be received by the fin sleeves;

DETAILED DESCRIPTION OF THE PREFERRED EMBODIMENTS

Figure 1:
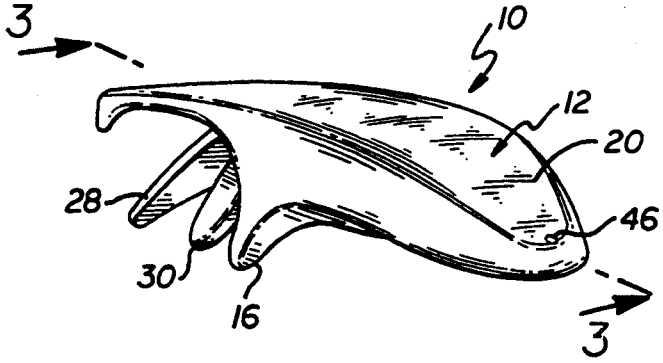
FIG. 1 is a top, front and right side perspective view of a body surfing board embodying the invention.

As shown in the drawings for purposes of illustration, the present invention is concerned with a body surfing board which is generally designated in the accompanying drawings by the reference number 10. In accordance with the present invention, and with reference initially to the embodiment illustrated in FIGS. 1–6, the body surfing board 10 comprises a hull 12 on which a swimmer 14 lies chest down while riding a wave toward shore, a pair of fins 16 extending below the hull 12, and a plurality of ribs 18 which define slits 19 through and around which water passes to propel the body surfing board forward.

The hull 12 forms a shark-shaped body having an upper surface 20 with a substantially horizontally and vertically rounded trunk 22, a concave lower surface 24, and a cone-shape nose section 26. A tail section 28 includes a keel 30 which extends downwardly from the lower surface 24 of the hull 12 and rearwardly of a rear edge of the hull.

The board 10 is preferably constructed of a resiliently flexible material which is relatively lightweight and buoyant. One such material is closed-cell polyethylene. The board 10 may be one molded piece or several pieces which are subsequently snapped together as one board. A body surfing board 10 capable of disassembly has the advantage of being easily transported, for example, in a car.

The board 10 also defines a pair of movable pectoral fins 16 forming winglike downwardly and rearwardly projecting extensions. The fins 16 move inwardly and outwardly, and are of sufficient thickness to include a sleeve 32 between outer and inner walls 34 and 36 thereof. The sleeves 32 are adapted to receive the swimmer's arms 38. The inner wall 36 of each fin 16 includes a plurality of circular openings 40 adapted to receive the swimmer's fingers 42. The swimmer should select those openings which provide the most comfort. The trunk 22 may further include openings 44 aft of the fins 16 to receive the swimmer's arms 38 and enable the swimmer to extend his arms through the board 10 and into the respective fin sleeve 32.

The nose section 26 is tapered forward and downwardly. The underside of the nose section 26 includes the ribs 18 which define the slits 19 through and around which water passes to move the body surfing board 10 through the water. The thin ribs 18 project in a laterally inboard direction from one side to the other. When the fins 16 are moved inwardly toward each other by the swimmer exerting force with his arms 38 in the fin sleeves 32, the nose section ribs 18 move to open the slits 19. The nose section 26 becomes more cone-shaped and water becomes displaced resulting in increased surfing speed. As the fins 16 are extended laterally outward, the ribs 18 move to close the slits 19, to minimize the flow of displaced water and thus slow down the board 10. The fins 16 are also moved independently of one another to control the direction of the board. If the swimmer wants to move the board 10 to the left, for example, the left fin is moved inwardly.

The nose section 26 also includes an air hole 46 to permit air to escape when the board is nose-down in the wave. This same hole may also serve as a cord attachment area for securing the board to the swimmer's wrist or ankle.

The keel 30 extends downwardly from the hull 12 to remain in the water at all times and assist in controlling the direction of the board 10. The tail section 28 may be unitary with the trunk 22 of the body board 10, or it may be a distinct appendage. The tail section 28 extends from the center rear of the body board trunk 22 and projects slightly downwardly. The tail section 28 acts both as a stabilizer and as a seat for the swimmer while floating or paddling on the water surface waiting for the next wave. The swimmer is thus able to avoid having to tread too much water and is also able to alleviate the problem of swimmer's knobs.

Figure 2:
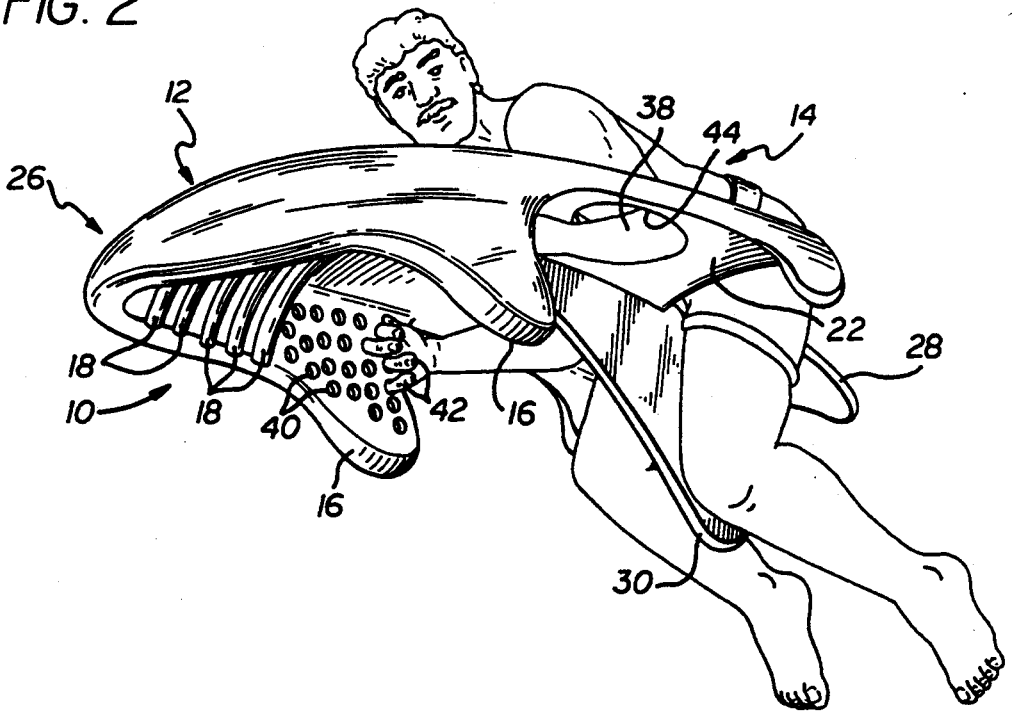
FIG. 2 is a bottom and left side perspective view of the body surfing board shown in FIG. 1, illustrating a swimmer in a seated, prone position on a tail section.
Figure 3:
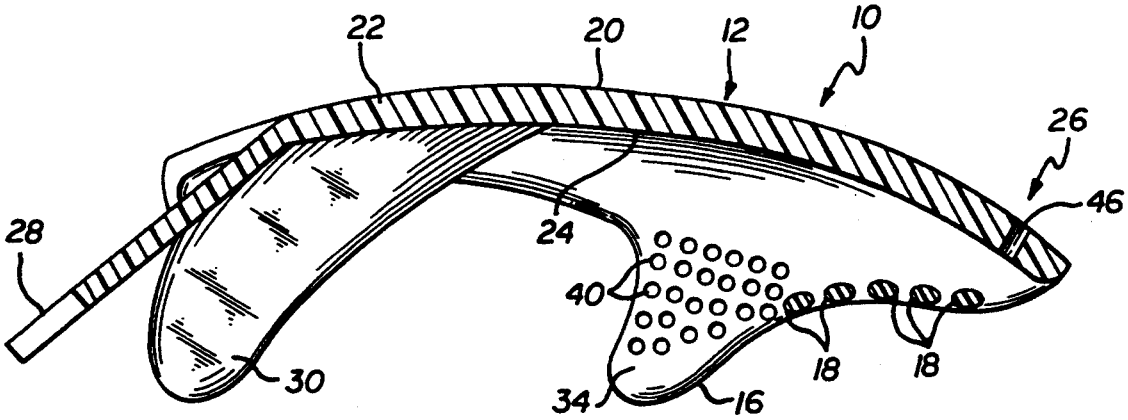
FIG. 3 is a vertical section of the body surfing board taken generally along the line 3—3 of FIG. 1.
Figure 7:
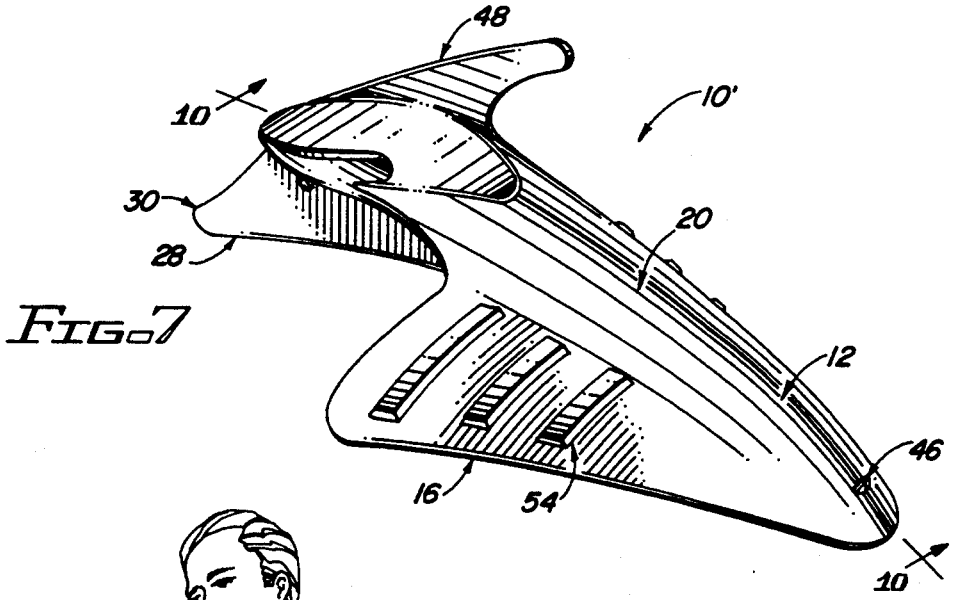
FIG. 7 is a top, front and right side perspective view of a second preferred form of the invention including a pair of aim-supporting pommels.
Figure 8:
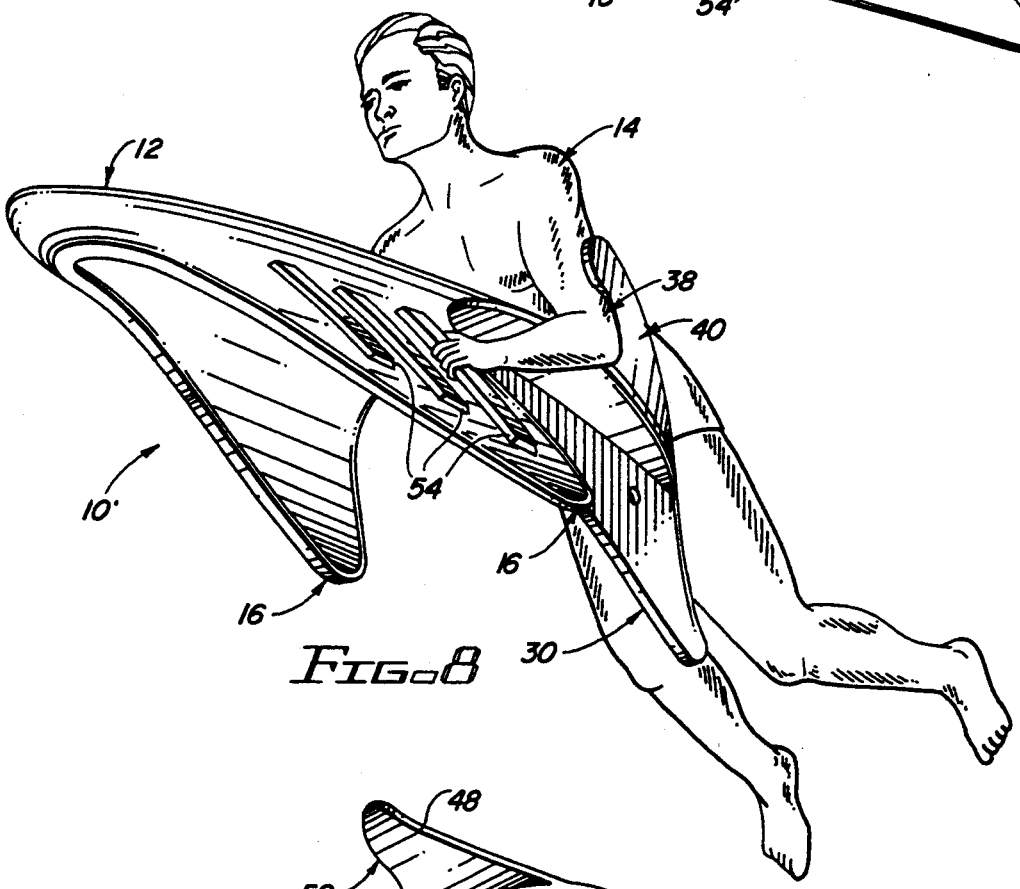
FIG. 8 is a bottom, front and left side perspective view of the body surfing board shown in FIG. 7, illustrating the swimmer in a prone position on a chest plate between the pair of pommels and holding a hand grip on the outer surface of a fin.
Figure 9:
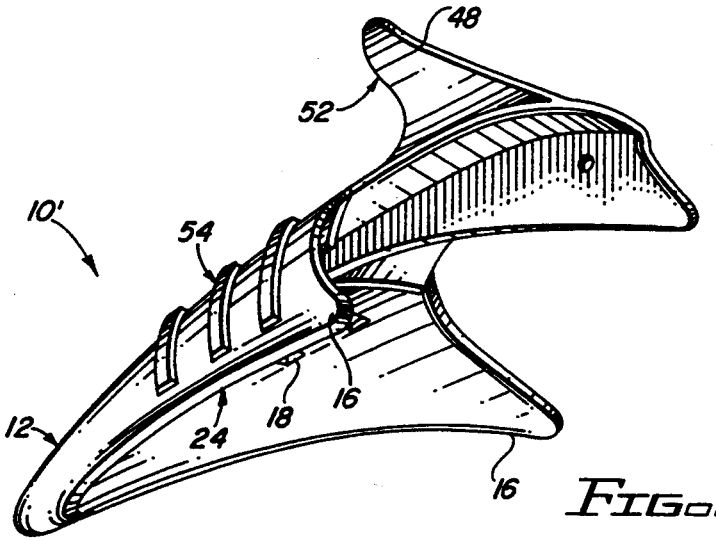
FIG. 9 is a bottom rear and left side perspective view of the body surfing board shown in FIGS. 7 and 8.
Figure 10:
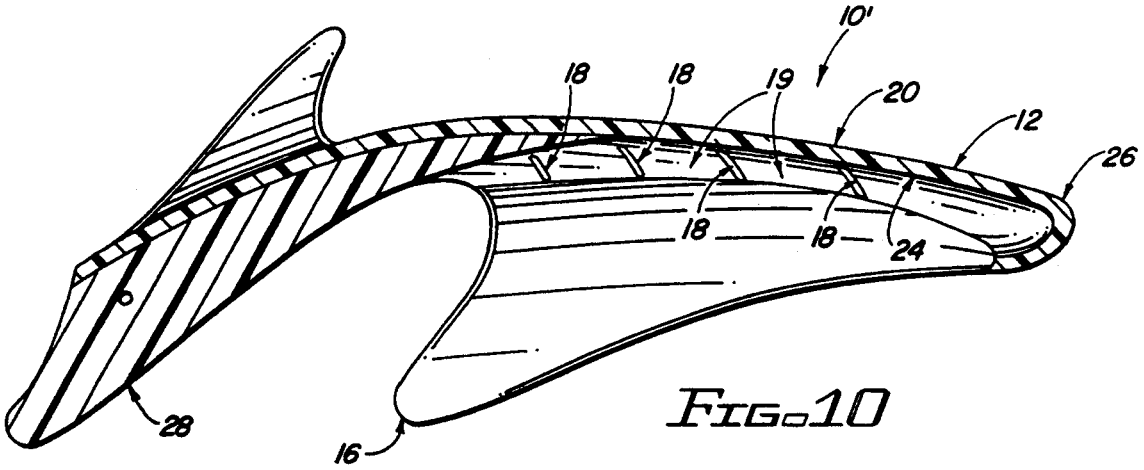
FIG. 10 is a vertical sectional view taken generally along the line 10—10 of FIG. 7.
Figure 11:
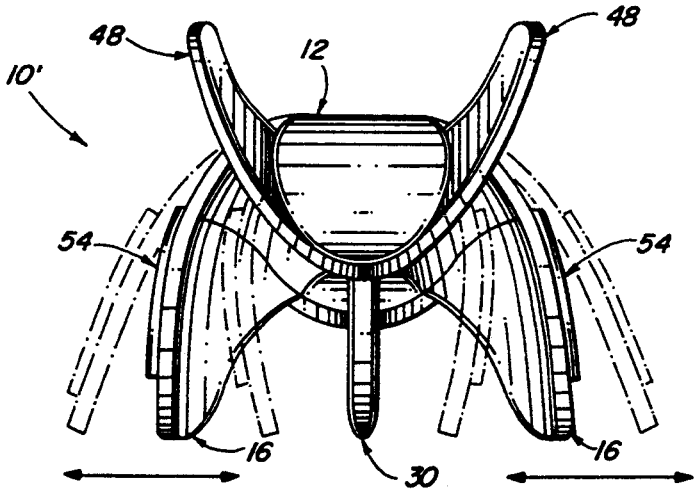
FIG. 11 is a rear elevational view of the body surfing board of FIGS. 7–10, illustrating movement of the fins as shown by the arrows.
Figure 12:
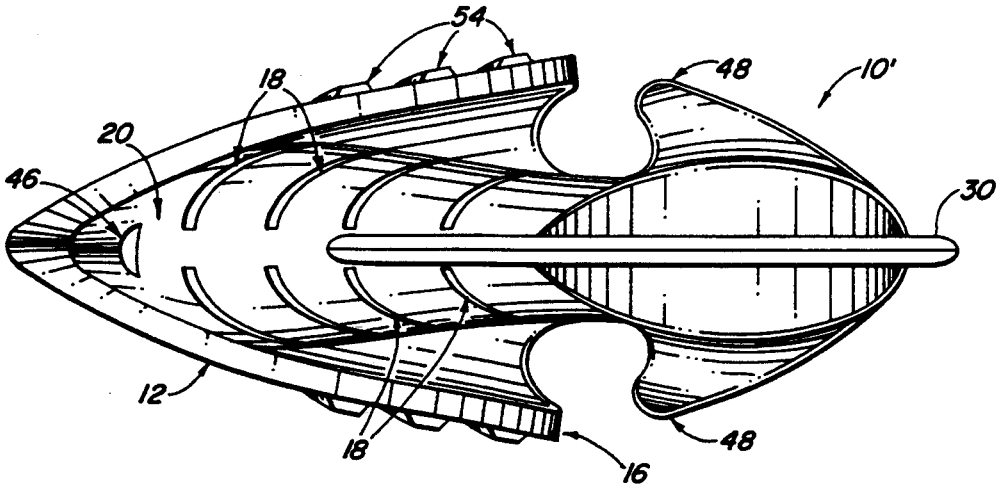
FIG. 12 is a bottom plan view of the body surfing board of FIGS. 7–11, showing slits in the underside of the nose section defined by a plurality of fixed ribs.

While waiting for a wave in the seated position, the swimmer's legs straddle the tail section 28. The knees are typically crouched along either side of the keel 30, and the swimmer's body should be on top of the board 10. As shown in FIG. 2, the swimmer extends his arms 38 through the openings 44 in the trunk 22 into the fin sleeves 32, and the fingers 42 engage the openings 40 which are the most comfortable for him. At the same time, his upper and lower torso find placement on the board trunk. In the riding position, the swimmer's legs extend astride each side of the tail section 28 in a planar relationship to the board 10. The tail section 28 of the board 10 permits positioning such that the seat is in the middle and the limbs may extend freely. In so positioning the body, the swimmer 14 is able to manipulate the improved body board 10 in and around the waves with sufficient control to stabilize the board in steep or tight turns, which makes the board appealing to both the novice and advanced swimmer.

With reference now to the embodiment illustrated in FIGS. 7–12, a second preferred embodiment of the body surfing board is illustrated and designated generally by the reference number 10'. In the following description and the accompanying drawings, elements of the body surfing board 10' which are functionally similar to the elements of the body surfing board 10 of FIGS. 1–6 are designated by the same reference numbers.

More particularly, the body surfing board 10' includes a buoyant, resiliently flexible hull 12, a tail section extending generally downwardly and rearwardly from the hull, and a pair of fins 16 which extend downwardly from the hull along opposite lateral edges thereof. The hull 12 includes in a lower surface 12 that rides on top of the water, an upper surface 20 which is adapted to receive the swimmer 14 in a chest down position with the feet of the swimmer projecting beyond a rear edge of the hull, and a nose section 26 which defines a forward end of the hull. The tail section includes a keel 30 which extends downwardly from the lower surface 24 of the hull 12, and rearwardly of the rear edge of the hull. The fins are each pivotable along their respective attachments to the hull 12, inwardly and outwardly with respect to one another (see FIG. 11).

In contrast with the body surfing board 10, the body surfing board 10' includes a pair of pommels 48 which are fixed to the hull 12 and extend upwardly therefrom adjacent to the rear edge thereof. The pommels provide means for supporting the backs of the swimmer's arms 38 in the manner shown in FIG. 8. A chest plate 50 is formed between the pommels 48, and may include a cross-ribbed surface for increased gripping. The pommels 48 define a curved forward edge 52.

The fins 16 do not include a sleeve 32 for receiving the hands and arms of the swimmer 14, but rather include hand grips 54 on an outer surface of the each fin. The hand grips 54 are grasped by the swimmer 14 to flex the fins 16 in the desired manner while body surfing.

The ribs 18 are provided within the nose section 26 of the hull 12, and are fixed to the lower surface 24 of the hull 12. In this embodiment, the size of the slits 19 between the ribs 18 do not change appreciably as the fins 16 are flexed inwardly and outwardly.

Figure 13:
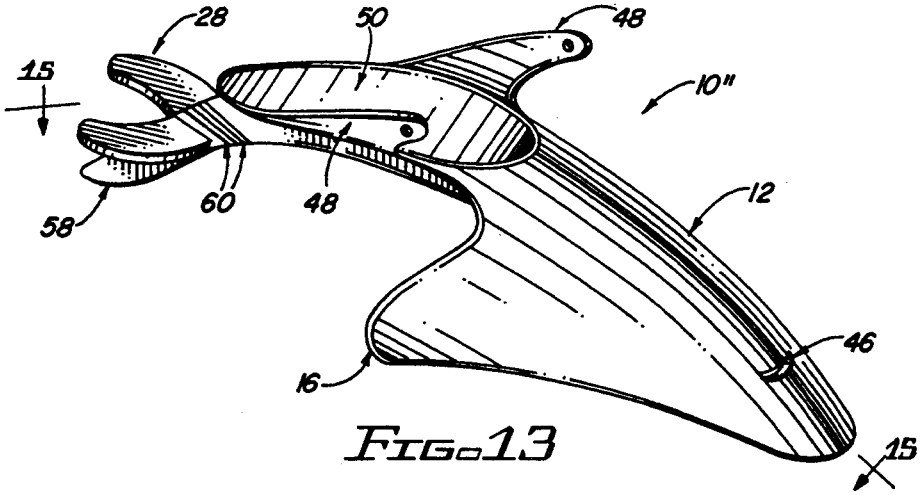
FIG. 13 is a top, front and right side perspective view of another, third preferred form of the invention.
Figure 14:
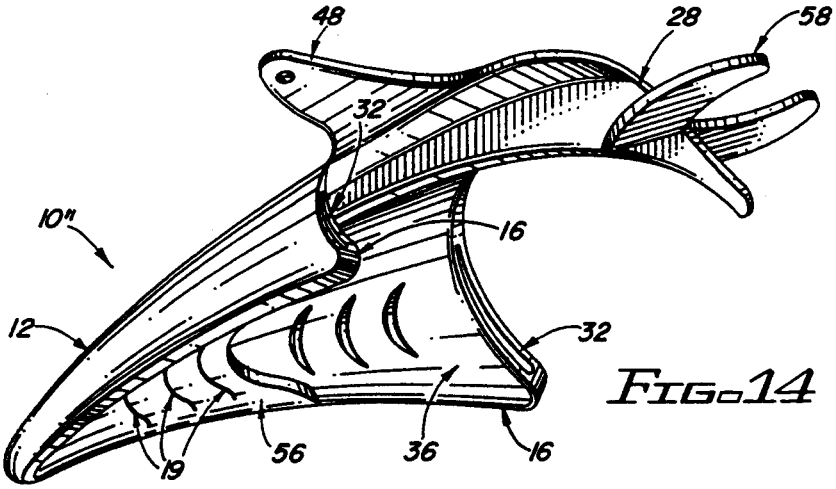
FIG. 14 is a bottom, rear and left side perspective view of the body surfing board of FIG. 13.
Figure 15:
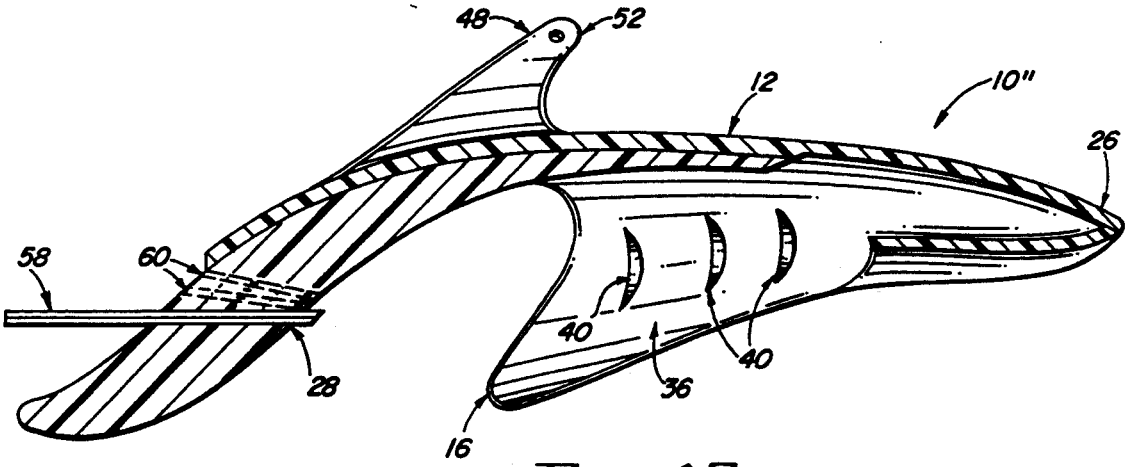
FIG. 15 is a vertical sectional view taken along the line 15—15 of FIG. 13, illustrating a tail fin engaged in one of a plurality of channels in a keel portion of the tail section.

FIGS. 13–15 illustrate yet another embodiment of the body surfing board, generally designated by the reference number 10''. Again, those components which are functionally similar to those depicted in the preceding description are given the same reference number.

In this embodiment, propulsion means are fixed to the lower surface 24 of the hull 12, for translating the force of a water wave into forward movement of the body surfing board 10'', in a manner similar to that illustrated in connection with the body board 10 of FIGS. 1–6. In the body surfing board 10'', however, the propulsion means utilizes a diaphragm member 56 having a plurality of ventricle openings or slits 19. In this case, when the fins 16 are moved inwardly toward each other, by the swimmer exerting force with his arms 38 in the fin sleeves 32, the nose section flexes the diaphragm member 58 to open the slits 19. The nose section 26 becomes more cone-shaped and water becomes displaced resulting in increased surfing speed. As the fins 16 are extended laterally outwardly, the diaphragm member 56 is relaxed which tends to close the slits 19, thus minimizing the flow of displaced water which results in slowing down the board 10''. Of course, the fins 16 can be moved independently of one another to control the direction of the board.

The inner wall 36 of each fin 16 is provided with elongated openings 40 through which the fingers 42 of the swimmer 14 extend.

The tail section 28 includes a tail fin 58 which is attached to the keel 30. The tail fin 58 extends in a plane generally perpendicular to a plane of the keel. A plurality of tail fin-receiving channels 60 are provided in the keel 30, into any one of which the tail fin 58 is placed for attaching the tail fin to the keel. The tail fin-receiving channels 60 are angularly displaced from one another to permit positioning of the tail fin 58 in an optimal surfing position.

Although several embodiments of the invention have been described in detail for purposes of illustration, various modifications of each may be made without departing from the spirit and scope of the invention. Accordingly, the invention is not to be limited, except as by the appended claims.

I claim:

1. A body surfing board, comprising:

a buoyant, resiliently flexible hull including a lower surface that rides on top of water, an upper surface adapted to receive a swimmer in a chest down position with the feet of the swimmer projecting beyond a rear edge of the hull, and a nose section defining a forward end of the hull;

a tail section including a keel extending downwardly from the lower surface of the hull and rearwardly of the rear edge of the hull;

a pair of fins extending downwardly from the hull along opposite lateral edges thereof, the fins each being pivotable along their respective attachments to the hull, inwardly and outwardly with respect to one another; and propulsion means fixed to the lower surface of the hull, for translating the force of a water wave into forward movement of the body surfing board, the propulsion means including a plurality of slits provided within the nose section and extending between the pair of fins.

2. The body surfing board of claim 1, including means for opening and closing the slits in response to inward and outward movement of the fins.

3. The body surfing board of claim 2, wherein the slits are defined by a plurality of ribs.

4. The body surfing board of claim 2, wherein the slits are incorporated into a diaphragm member.

5. The body surfing board of claim 1, wherein each fin includes an inner wall and an outer wall which define a sleeve therebetween, and apertures through the inner sleeve which are adapted for receiving the fingers of the swimmer.

6. The body surfing board of claim 1, wherein each fin includes an outer surface having a plurality of hand grips for the swimmer.

7. The body surfing board of claim 1, including a pair of pommels fixed to the hull and extending upwardly therefrom adjacent to the rear edge thereof, the pommels providing means for supporting the backs of the swimmer's arms.

8. The body surfing board of claim 1, wherein the tail section includes a tail fin attached to the keel, the tail fin extending in a plane generally perpendicular to a plane of the keel.

9. The body surfing board of claim 8, including a plurality of tail fin-receiving channels in the keel, into any one of which the tail fin is placed for attaching the tail fin to the keel.

10. A body surfing board, comprising:

a buoyant, resiliently flexible hull including a lower surface that rides on top of water, an upper surface adapted to receive a swimmer in a chest down position with the feet of the swimmer projecting beyond a rear edge of the hull, and a nose section defining a forward end of the hull;

a pair of pommels fixed to the hull and extending upwardly therefrom adjacent to the rear edge thereof, the pommels providing means for supporting the backs of the swimmer's arms;

a tail section including a keel extending downwardly from the lower surface of the hull and rearwardly of the rear edge of the hull;

a pair of fins extending downwardly from the hull along opposite lateral edges thereof, the fins each being pivotable along their respective attachments to the hull, inwardly and outwardly with respect to one another; and propulsion means fixed to the lower surface of the hull, for translating the force of a water wave into forward movement of the body surfing board, the propulsion means including a plurality of slits provided within the nose section and extending between the pair of fins.

11. The body surfing board of claim 10, including means for opening and closing the slits in response to inward and outward movement of the fins.

12. The body surfing board of claim 11, wherein the slits are defined by a plurality of ribs.

13. The body surfing board of claim 11, wherein the slits are incorporated into a diaphragm member.

14. The body surfing board of claim 10, wherein each fin includes an inner wall and an outer wall which define a sleeve therebetween, and apertures through the inner sleeve which are adapted for receiving the fingers of the swimmer.

15. The body surfing board of claim 10, wherein each fin includes an outer surface having a plurality of hand grips for the swimmer.

16. The body surfing board of claim 10, wherein the tail section includes a tail fin attached to the keel, the tail fin extending in a plane generally perpendicular to a plane of the keel.

17. The body surfing board of claim 16, including a plurality of tail fin-receiving channels in the keel, into any one of which the tail fin is placed for attaching the tail fin to the keel.

18. The body surfing board of claim 17, wherein the tail fin-receiving channels are angularly displaced from one another.

19. A body surfing board, comprising:

a buoyant, resiliently flexible hull including a lower surface that rides on top of water, an upper surface adapted to receive a swimmer in a chest down position with the feet of the swimmer projecting beyond a rear edge of the hull, and a nose section defining a forward end of the hull;

means for supporting the backs of the swimmer's arms, the supporting means including a pair of pommels fixed to the hull and extending upwardly therefrom adjacent to the rear edge thereof;

a tail section including a keel extending downwardly from the lower surface of the hull and rearwardly of the rear edge of the hull, and a tail fin attached to the keel, the tail fin extending in a plane generally perpendicular to a plane of the keel;

a pair of fins extending downwardly from the hull along opposite lateral edges thereof, the fins each being pivotable along their respective attachments to the hull, inwardly and outwardly with respect to one another, each fin including an outer surface having a plurality of hand grips for the swimmer; and propulsion means fixed to the lower surface of the hull, for translating the force of a water wave into forward movement of the body surfing board, the propulsion means including a plurality of slits incorporated into a diaphragm member provided within the nose section and extending between the pair of fins, and means for opening and closing the slits in response to inward and outward movement of the fins.

20. A body surfing board, comprising:

a buoyant, resiliently flexible hull including a lower surface that rides on top of water, an upper surface adapted to receive a swimmer in a chest down position with the feet of the swimmer projecting beyond a rear edge of the hull, and a nose section defining a forward end of the hull;

a tail section including a keel extending downwardly from the lower surface of the hull and rearwardly of the rear edge of the hull, a tail fin attached to the keel wherein the tail fin extends in a plane generally perpendicular to a plane of the keel, and a plurality of tail fin-receiving channels in the keel, into any one of which the tail fin is placed for attaching the tail fin to the keel;

a pair of fins extending downwardly from the hull along opposite lateral edges thereof, the fins each being pivotable along their respective attachments to the hull, inwardly and outwardly with respect to one another; and propulsion means fixed to the lower surface of the hull, for translating the force of a water wave into forward movement of the body surfing board.

* * * * *